US005762232A

United States Patent [19]

Green et al.

[11] Patent Number: 5,762,232

[45] Date of Patent: Jun. 9, 1998

[54] FUEL TANK HAVING INTEGRAL STRUCTURAL FRAMEWORK

[75] Inventors: Vincent D. Green, East Syracuse; Paul J. Spaulding, Syracuse, both of N.Y.

[73] Assignee: Carrier Corporation, Syracuse, N.Y.

[21] Appl. No.: 763,771

[22] Filed: Dec. 11, 1996

[51] Int. Cl.[6] ..... B65D 45/00

[52] U.S. Cl. ..... 220/564; 220/4.14

[58] Field of Search ..... 220/562, 563, 220/564, 4.12, 4.13, 4.14, 4.15, 4.27

[56] References Cited

U.S. PATENT DOCUMENTS

| | | | |
|---|---|---|---|
| 2,181,772 | 11/1939 | Snyder | 220/564 X |
| 2,530,819 | 11/1950 | Hamlin | 220/4.14 X |
| 2,569,493 | 10/1951 | Prior | 220/564 X |
| 2,794,569 | 6/1957 | McCuen | 220/564 |
| 2,806,622 | 9/1957 | Leirer | 220/4.14 |
| 2,832,501 | 4/1958 | Durand | 220/564 X |
| 2,927,711 | 3/1960 | Naggiar | 220/564 |
| 3,319,433 | 5/1967 | Pauliukonis et al. | 220/564 X |
| 3,940,009 | 2/1976 | Szeles | 220/564 |
| 5,590,806 | 1/1997 | Green et al. | 220/4.14 X |

*Primary Examiner*—Steven M. Pollard

[57] ABSTRACT

A U-shaped fuel tank for a self contained generator set of the type adapted to be mounted on a refrigerated container has an integral structural framework. The framework includes an H-shaped structure defined by a horizontal structural plate which serves as a wall of a lower section of the tank as well as the primary support for the motor and generator. Vertically extending structural plates attached to opposite ends of the horizontal plate serve as walls for vertical tank sections as well as structural components and baffles within the interior of the tank.

6 Claims, 8 Drawing Sheets

FUEL TANK HAVING INTEGRAL STRUCTURAL FRAMEWORK

BACKGROUND OF THE INVENTION

The present invention relates to self contained engine driven electrical generators. More particularly, the invention relates to the structure of a fuel tank for a self contained engine driven electrical generator of the type used in connection with a refrigerated transport container wherein the engine, generator, fuel tank and other principal components are assembled in a single unit.

An increasingly popular way of transporting goods makes use of removable cargo carrying containers, commonly referred to as "intermodal" containers, which are adapted for transport over both land and water. Such containers are designed for transport by truck or rail to a freight terminal or ship loading dock, where they may be transferred to a ship for overseas delivery.

Many of such containers are provided with refrigeration units which allow them to transport perishable goods therein. The refrigeration units attached to such containers include an electric motor for driving a refrigerant compressor forming a part of the unit. As a result, they require a source of electrical power for operation. When located at a freight terminal, a refrigerated container is provided with electrical power through a connection to a conventional source of electrical power. When located on a ship, a refrigerated container receives electrical power from the ship's electrical system. When being transported by road, rail or when no other power source is available, a self contained temporary power source which includes a motor generator set, may be mounted directly to the refrigerated container.

Since the generator set is a self-contained source of auxiliary power, it is necessary that an integral part thereof be a fuel tank for the motor, which is typically a diesel engine. Many generator sets are required to have the capability to provide uninterrupted service for an extended length of time. For example, for transcontinental rail shipping, it is desirable to have a generator set which is capable of operating for more than 130 hours without requiring refueling. Such extended use capabilities also will increase the reliability of the system and decrease operating costs. Accordingly, it is desirable to provide a high capacity integral fuel tank for such a generator set.

It should be appreciated that space is extremely limited in the design of such a generator set. Such space limitations are a result of the environment in which they are used wherein there are limitations on components extending beyond a prescribed envelope universally defined by the width of the containers on which they are used. Also, because such generator sets are quite often mounted on containers being towed by tractor trailers, size limitations are dictated by the necessity of providing adequate clearance between the generator and the tractor unit. Further space limitations are dictated by the requirement that the generator set not extend vertically above the top of the container on which it is mounted nor should it extend downward such that it would interfere with the condenser discharge and the operating controls of the refrigeration unit.

One approach to achieving a high capacity fuel tank has been to provide a substantially U-shaped fuel tank having a lower section, which underlies and supports the motor generator and other components of the generator set and which comprises vertically extending sections on one or both sides of the generator set. U.S. patent application entitled "Fuel Tank Having Pass Through Conduits", assigned to the assignee of the present invention, was filed on Dec. 26, 1995, as U.S. application Ser. No. 08/578,400. The '400 patent application discloses a fuel tank design for a self contained motor generator set wherein passageways are formed in sections of the fuel tank, which allow passage of the motor generator assemblies exhaust pipe and power cables therethrough.

In order to mount such a motor generator set onto a container, it is necessary that the mounting device and the entire motor generator set be structurally robust. One approach to this, which is well known in the prior art, has been to fabricate fuel tanks for such units from steel plates which are welded together at all of the joints to form a integral tank. A structural steel support frame is then welded to the assembled fuel tank to provide the required structural integrity to support the tank, the generator and engine assembly and other components. The steel frame in turn has attached thereto mounting hardware adapted to mount the entire unit to a refrigerated container over the front of an electric powered refrigeration unit.

SUMMARY OF THE INVENTION

The present invention relates to a fuel tank for a self contained generator set of the type adapted to be mounted on a transport container, which has a refrigeration unit mounted on one end thereof. The fuel tank comprises an integral structural framework which includes a first substantially horizontal structural plate having first and second ends. A first substantially vertical, elongated structural plate is joined at a location on one side of the plate, intermediate the length thereof, to the first end of the horizontal plate. A second substantially vertical, elongated structural plate is joined at a location on one side of the second plate, which is intermediate the length thereof to the second end of the horizontal plate. The first horizontal plate and the first and second vertical plates cooperate to define a substantially H-shaped structural framework for the fuel tank. The fuel tank further includes a lower tank section underlying the horizontal plate. The horizontal plate defines the upper surface of the lower tank section. A first vertically extending tank section is provided adjacent the other side of the first vertical plate. The first vertical plate forms one of the sides of the first vertical tank section. In a like manner, a second vertically extending tank section is provided adjacent the other side of the second vertical plate. The second vertical plate forming one side of the second vertical tank section. Each of the lower, first and second vertically extending tank sections, are fluidly interconnected to one another to define the interior of the fuel tank. The portion of the first and second vertical plates, which extend above their joint with the horizontal plate, form one side of the first and second vertical tank sections, respectively. The portions of the first and second vertical plates which extend below the joints with the horizontal plate extend into the interior of the fuel tank.

BRIEF DESCRIPTION OF THE DRAWINGS

This invention may be better understood and its objects and advantages will become apparent to those skilled in the art by reference to the accompanying drawings, in which.

DESCRIPTION OF THE PREFERRED EMBODIMENT

Figure 1:
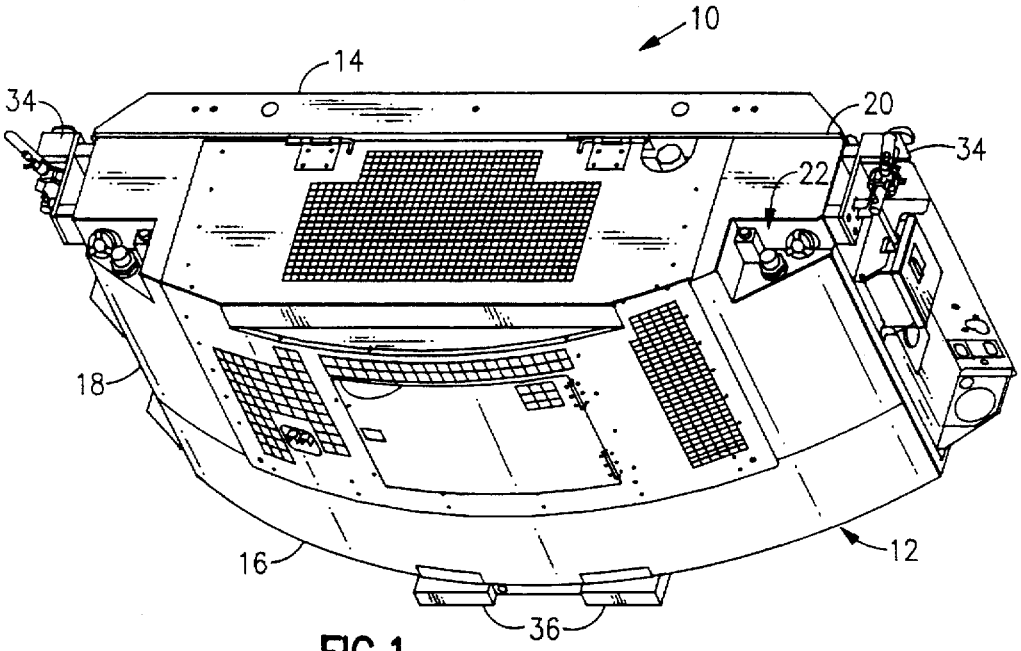
FIG. 1 is a perspective view of a self contained generator set having a fuel tank according to the present invention with the outer cover installed.

FIG. 1 is a perspective view of a diesel driven generator set 10, which is adapted for mounting on the end of a refrigerated container in order to provide electric power to a refrigeration unit which is also mounted on the container. In operation, the generator set 10 provides a constant electrical power supply for operation of the all electric refrigeration unit. A container refrigeration unit adapted for mounting on a refrigerated container, and with which the generator set of the present invention may be used, is manufactured and sold by the Carrier Transicold Division of Carrier Corporation and marketed as Model Series NT.

Referring now to FIGS. 1, 3, 4, 5 and 6, the structural framework of the generator set comprises a U-shaped fuel tank generally designated by reference numeral 12 and a number of structural elements, including an angle iron 14, which extends across substantially the entire back of the generator set. The general arrangement of the components and the external fuel tank structure will be described before a detailed description of the tank structure and internal components according to the invention.

The fuel tank 12, fabricated from structural steel plate, comprises a lower section 16, which extends across substantially the entire bottom of the generator set 10.

Extending vertically upward from the left and right hand sides of the lower tank 16 are left and right hand tower portions of the fuel tank, 18 and 20, respectively. As will be described in more detail, each of the towers 18 and 20 is fluidly interconnected with the lower tank section 16. Each of the towers 18 and 20 is provided, at its upper end thereof, with a fuel fill shelf 22, which is provided with an appropriate fuel fill 24, fuel gage 26 and fuel vent 28.

The previously described structural angle iron 14 is welded to the top of the back side of the fuel tank towers 18 and 20. Other external structural elements include left and right hand vertical structural members 30 and 32, respectively, located at the left and right hand ends of the generator set. These structural members 30 and 32 are welded to the left and right hand facing surfaces of the fuel tank towers 18 and 20, respectively and serve as the vertical supports for the generator set. Mounted to the upper end of the structural elements 30 and 32 are suitable clamps 34 well known in the art, which are adapted to structurally attach the generator set 10 to a refrigeration container of the type shown in FIG. 2.

Underlying the lower section 16 of the fuel tank 12 are a pair of structural forklift pockets 36, which form an integral part of the generator set structure and facilitate engagement by a forklift for lifting the unit and positioning it for attachment to a refrigerated container.

Figure 3:
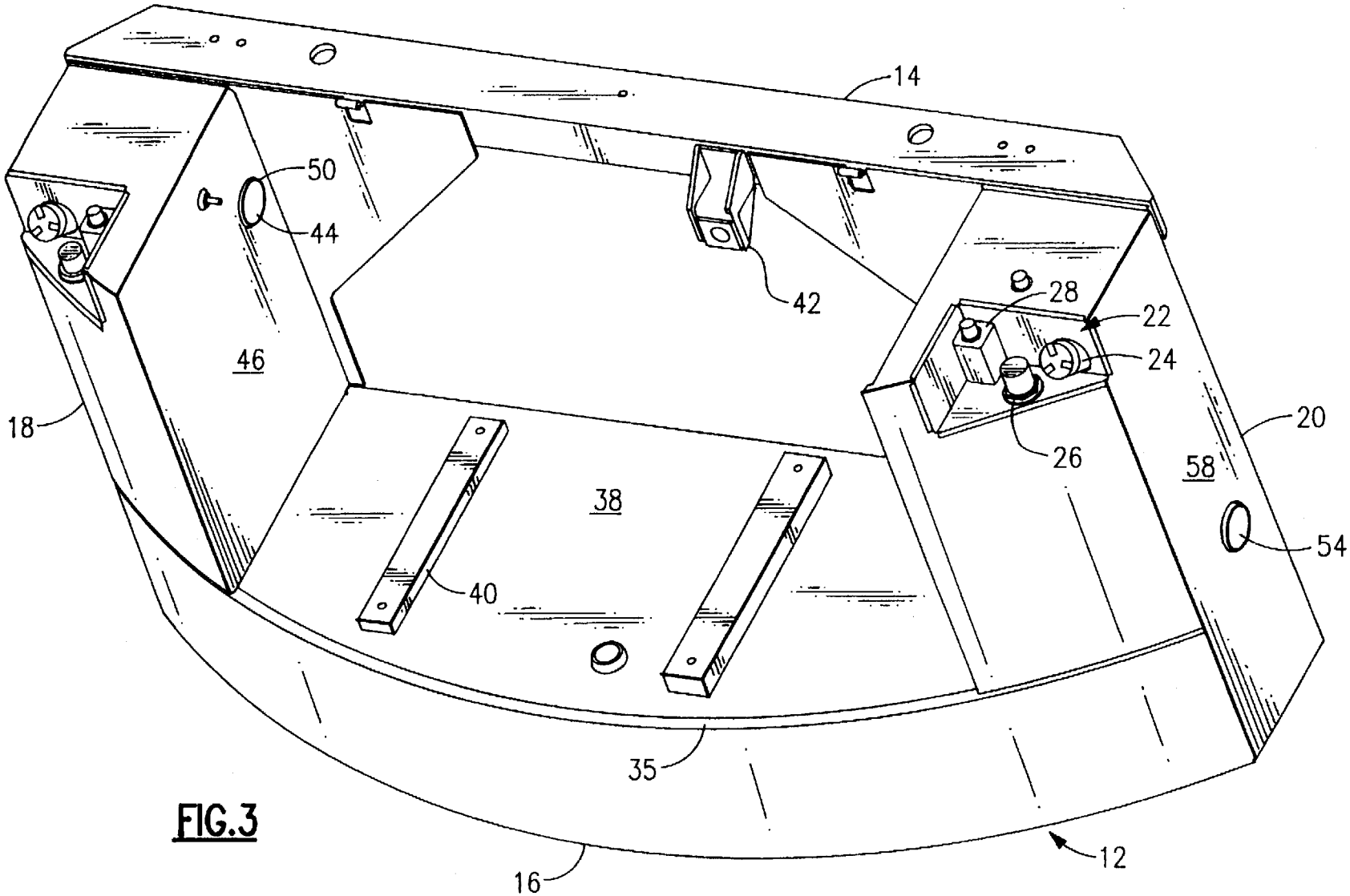
FIG. 3 is an enlarged perspective view of the generator set of FIG. 1 with most of the mechanical components removed therefrom to show details of the fuel tank according to the present invention.

As best shown in FIG. 3, a horizontal plate 35 forms the top of the lower section 16 of the fuel tank and defines an upwardly facing planar surface 38 on which are attached a pair of mounting bars 40. Attached to the angle iron 14 is an angular mounting bracket 42. The mounting bars and the bracket are the attachment points for the motor and generator of the generator set.

Figure 2:
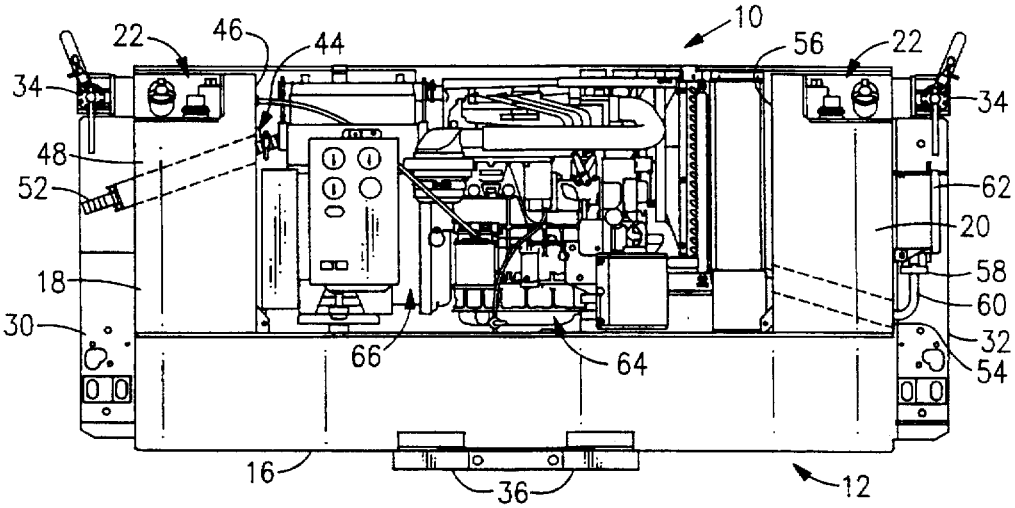
FIG. 2 is a front elevation view of the generator set of FIG. 1 with the cover removed.

As best shown in FIGS. 2 and 3, the left hand fuel tank tower 18 is provided with a circular passage 44 extending from the interior wall 46 thereof to the exterior wall 48. The passage is formed from a steel pipe section 50 integrally welded to openings cut into the walls 46 and 48. The exhaust pipe 52 from the engine of the generator set passes through the passage 44. In a like manner, the right hand tower 20 of the fuel tank is provided with a passage 54 extending from the interior wall 56 to the exterior wall 58 thereof. This passage 54 is adapted to receive the power cable 60, which interconnects the generator set 10 with a receptacle box 62 mounted on the right hand vertically extending structural member 32.

It should be appreciated that both of the passages 44 and 54 provide a convenient, easily fabricated passageway from the interior of the "confines" of the generator set 10 with a minimum of additional parts and while allowing the maximum capacity of the fuel tank. Each passage requires a simple length of purchased pipe or tubing, cut to length, and a single hole being cut in each panel of the fuel tank which is penetrated. The welding of the pipes to the fuel tank panels are relatively simple circumferential fillet welds.

Looking now at FIG. 2, the generator set includes principally a diesel engine 64 and a generator 66, which is coupled directly to the engine flywheel. The generator provides a constant 460 vac three phase, 60 hertz electrical supply which is conducted from the generator 66 via the power cable 60.

As previously described, the main vertical supports for mounting of the generator set 10 onto a refrigerated container are the vertically extending left and right hand side supports 30 and 32, respectively. These vertical supports are welded to the exterior walls 48 and 58 of the left and right hand fuel tank towers 18 and 20, respectively. While the actual welds are not shown, it should be appreciated that welds for achieving structural joining of metal components are well known in the prior art and any where in the description which follows where a structural welded joint is described, it is understood to be of this type of weld without a detailed showing or description thereof.

Figure 4:
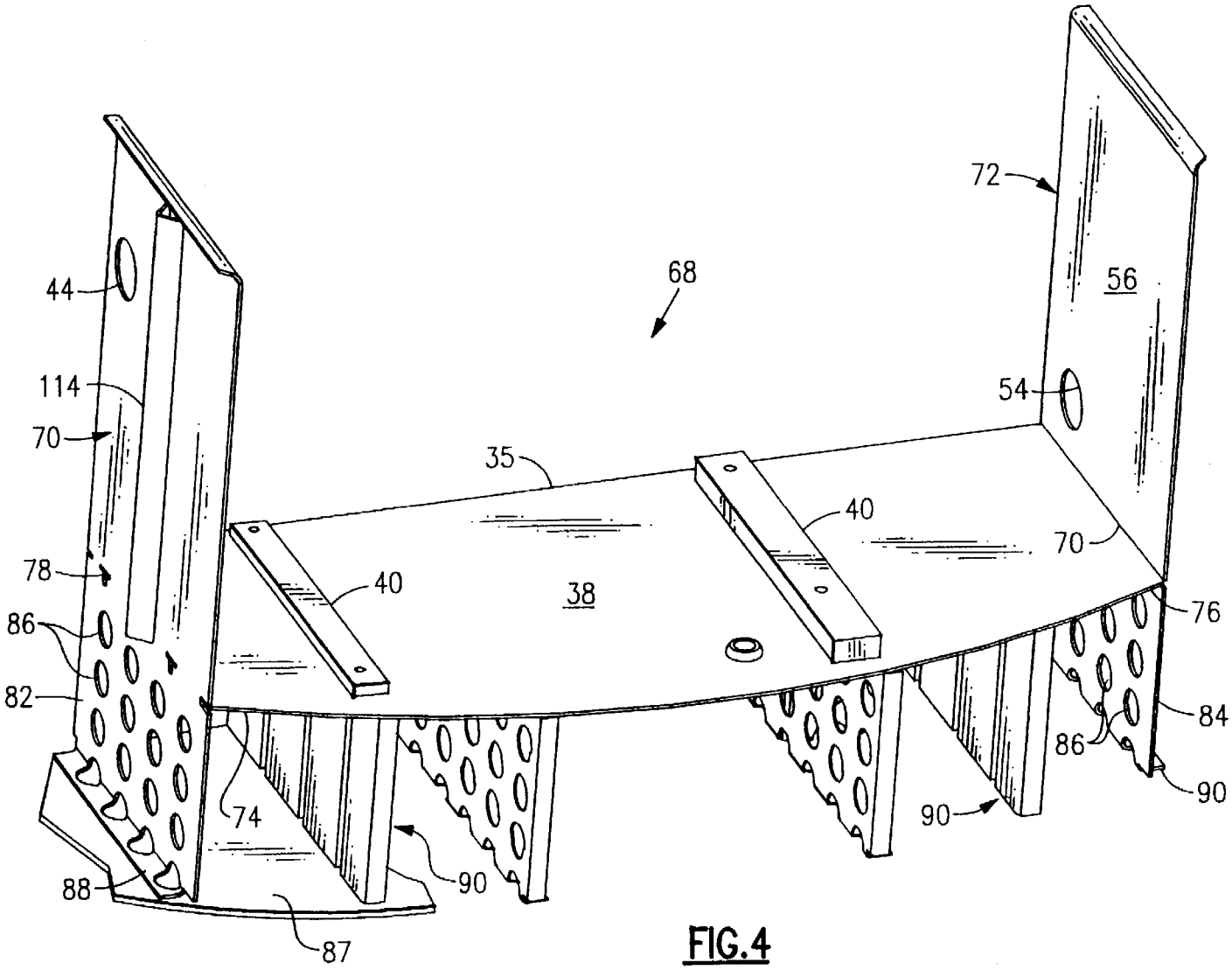
FIG. 4 is a perspective view of the structural framework of a fuel tank of the type shown in FIG. 3.
Figure 5:
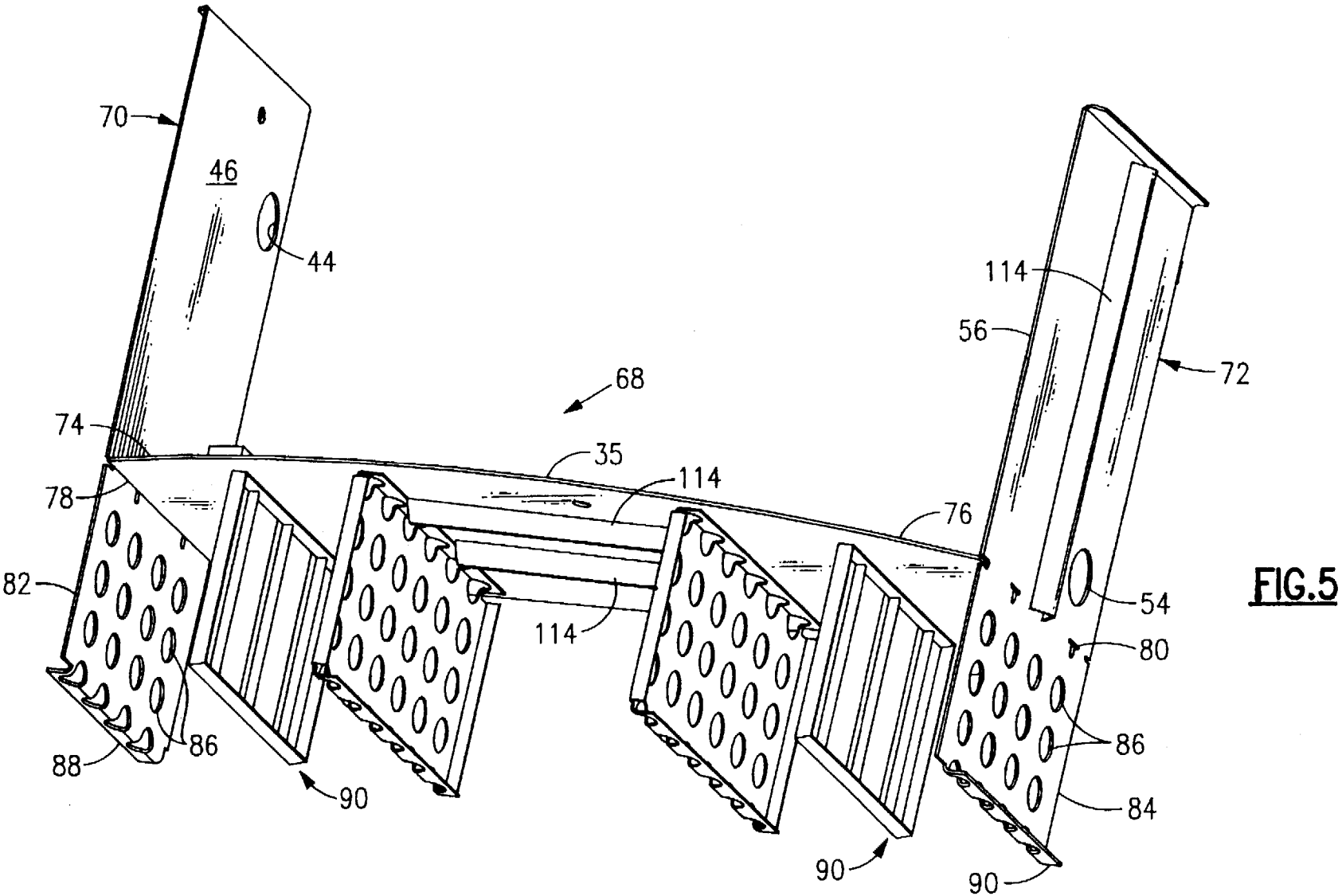
FIG. 5 is a perspective view similar to FIG. 4 showing the underside of the structural framework.
Figure 6:
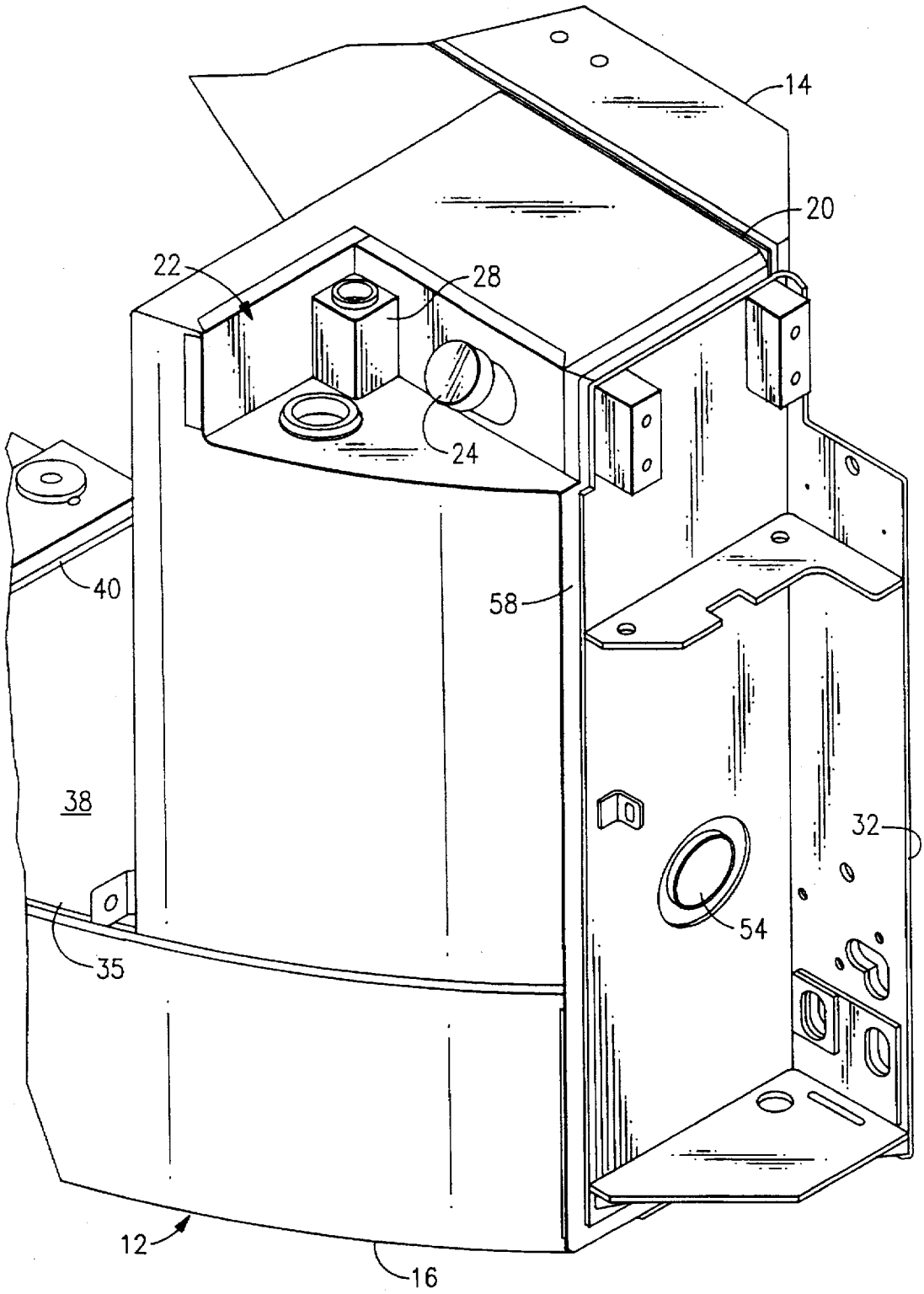
FIG. 6 is an enlarged view of the right end of the generator set shown in FIG. 1 with most of the components thereof removed to show a main vertical structural support.

Looking now at FIGS. 3, 4 and 5, it will be appreciated how the internal structural framework and the assembly of the fuel tank 12 are such that they allow the vertical support elements 30 and 32 to carry load of the entire generator set 10 through the integral structural framework of the fuel tank without requiring a separate structural framework.

Looking now at FIGS. 4 and 5, a basic H-shaped structural framework 68, for the fuel tank 12 is illustrated. The primary elements of the H-shaped structural framework 68 are the horizontally extending plate 35, which forms the top of the lower section 16 of the fuel tank and vertically extending elongated structural plates 70 and 72 at the left and right hand ends, respectively, of the horizontal plate 35.

The vertically extending plates 70 and 72 are substantially identical, with the exception of the location of a circular opening therein, which corresponds with the through passages 44 and 54 in the left and right hand fuel tank towers 18 and 20, respectively. In that regard, it should be noted that the left hand vertical section 70 defines the interior wall 46 of the left hand tank section 18. Likewise, the right hand vertically extending section 72 defines the interior wall 56 of the right hand fuel tank tower 20.

Each of the vertical sections 70 and 72 is structurally attached to one end, 74 and 76, respectively, of the horizontal structural plate 35. The joints 78 and 80, respectively, on the left and right hand ends, are mechanical, as by slot and tab engagement to facilitate alignment and also by structural welding to form a joint having a substantial structural integrity.

As mentioned above, the portion of the vertical plates 70 and 72 extending above the joints 78 and 80 define walls of the fuel tank 12. The portion of each of the vertical plates 70 and 72, which extend below the joints with the plate 3 5, 82 and 94, respectively, it extend downwardly into the lower section 16 of the fuel tank. Each of these sections 82 and 84 are provided with a plurality of through openings 86 therein to facilitate free flow of fuel within the interior of the fuel tank. The lower ends 88 and 90 of the sections 82 and 84 are each provided with a right angle flange which is welded to the bottom plate 88 of the fuel tank as is illustrated in a representative fashion in FIG. 4.

Additional substantial structural integrity of the fuel tank is achieved by the use of a pair of internal structural baffles 90, which extend between the lower surface of the horizontal plate 35 and the inner surface of the lower fuel tank plate 88 as best illustrated in FIGS. 4 and 5. Additional baffle elements 92 also extend between the plate 35 and the bottom 88 and are provided with a plurality of through openings 94 to permit free flow of fuel therethrough while adding structural rigidity to the tank structure. Both the structural baffles 90 and the baffles 92 are welded to not only the upper and lower surfaces described, but also to the backside of the tank 93.

Looking now in detail at FIGS. 7 through 11, the structural baffle 90, which is fabricated from a single sheet of plate steel, provides a both a high degree of structural rigidity as well as the necessary fuel flow openings therethrough which are required of a baffle. The baffle 90 comprises basically a planar section 94 having right angled flanges 98 formed at each of the four edges thereof to facilitate welded contact of the baffle to the adjacent tank wall sections. A plurality of vertically extending openings 100 are formed in the flange, each of which has a ninety degree bent section associated therewith to form an interior flange 102.

Figure 10:
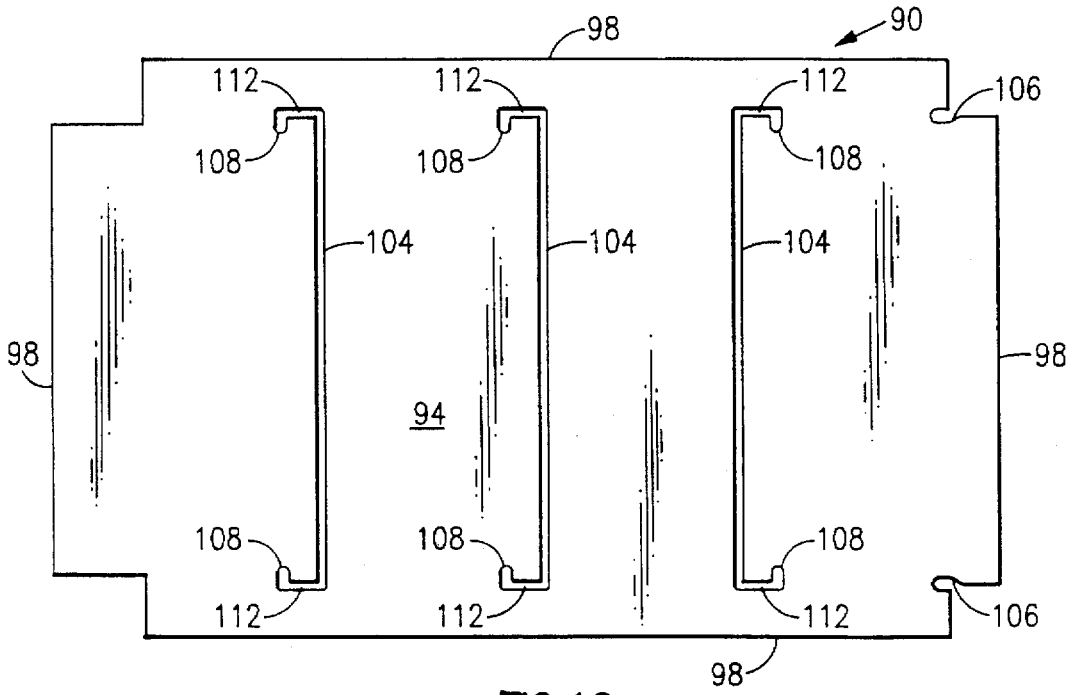
FIG. 10 illustrates a plan view of a baffle of the type illustrated in FIG. 7 following machining and prior to forming.

Looking at FIG. 10, a baffle 90 is shown after having been stamped from a larger piece of sheet metal. It will be noted that three internal elongated C-shaped openings 104 have been punched into the planar section 94. Appropriate radius cuts are made in the sheet as at the right hand end at 106 and at ends 108 of each of the C-shaped openings to facilitate stress relief when the appropriate bends are made to form the baffle 90.

Figure 8:
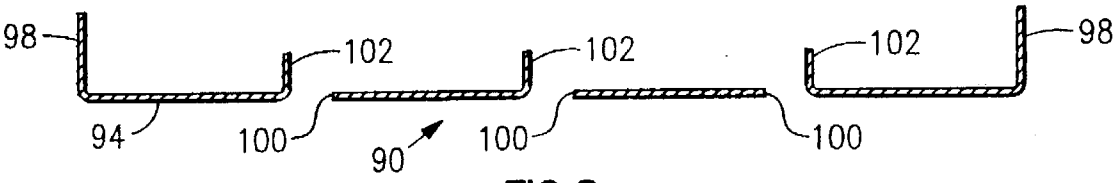
FIG. 8 is a sectional view taken along the line 8—8 of FIG. 7.
Figure 9:
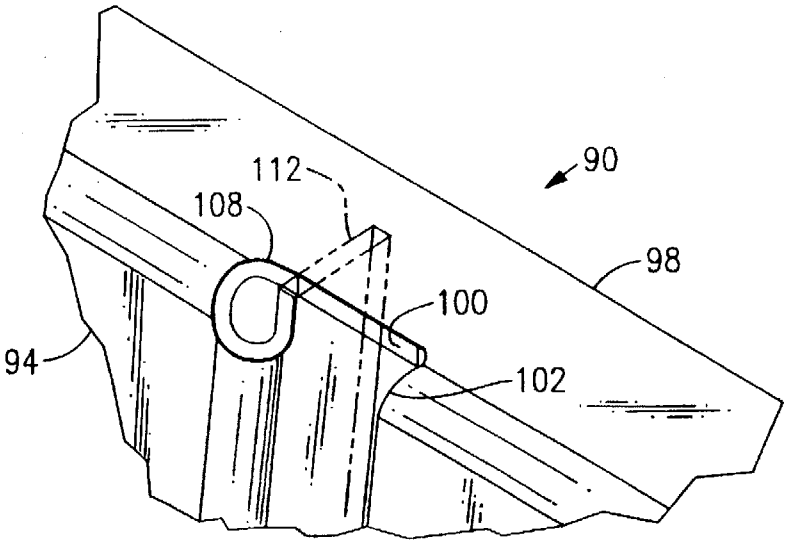
FIG. 9 is an enlarged detailed view of the portion in FIG. 7 identified by a dashed line circle.
Figure 7:
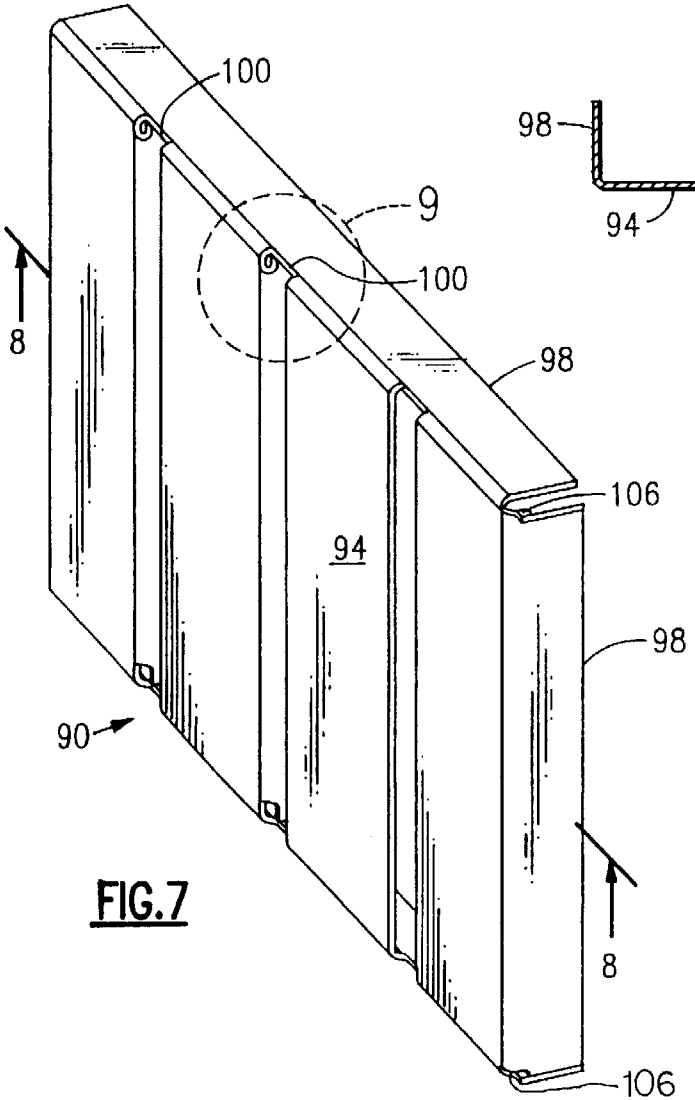
FIG. 7 is a perspective view of an internal structural baffle of the type shown in FIGS. 4 and 5.
Figure 11:
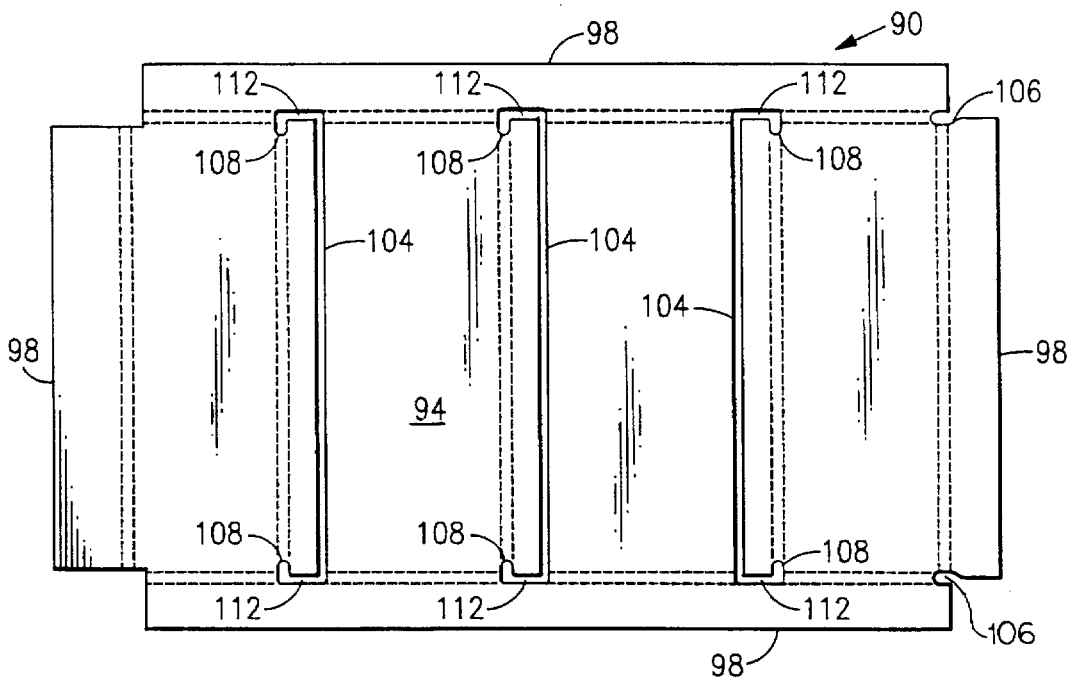
FIG. 11 is a view similar to FIG. 10 showing the bend lines followed in forming the baffle.

Looking now at FIG. 11, the phantom lines indicate the lines at which longitudinal ninety degree bends are made in order to form the baffle 90 as illustrated in FIGS. 7, 8 and 9. Following the bends made as indicated in FIG. 1, it will be appreciated that the material defined by the elongated C-shaped openings 104 and the bend lines 110 associated therewith, in FIG. 11, define the vertical openings 100. Further, the material which occupied the openings is then appropriately bent into position to form the interior flanges 102. The opposite ends 112 of each of the interior flanges 102 is then in confronting relationship with the inside edge of one of the outer flanges 98 as best shown in FIG. 9. At this point, the ends 112 of the interior flanges 102 may then be welded to the inside edges of the outer flanges 98 to thereby form three rigid I-beam type webs and further increase the structural rigidity and integrity of the baffle 90.

Figure 12:
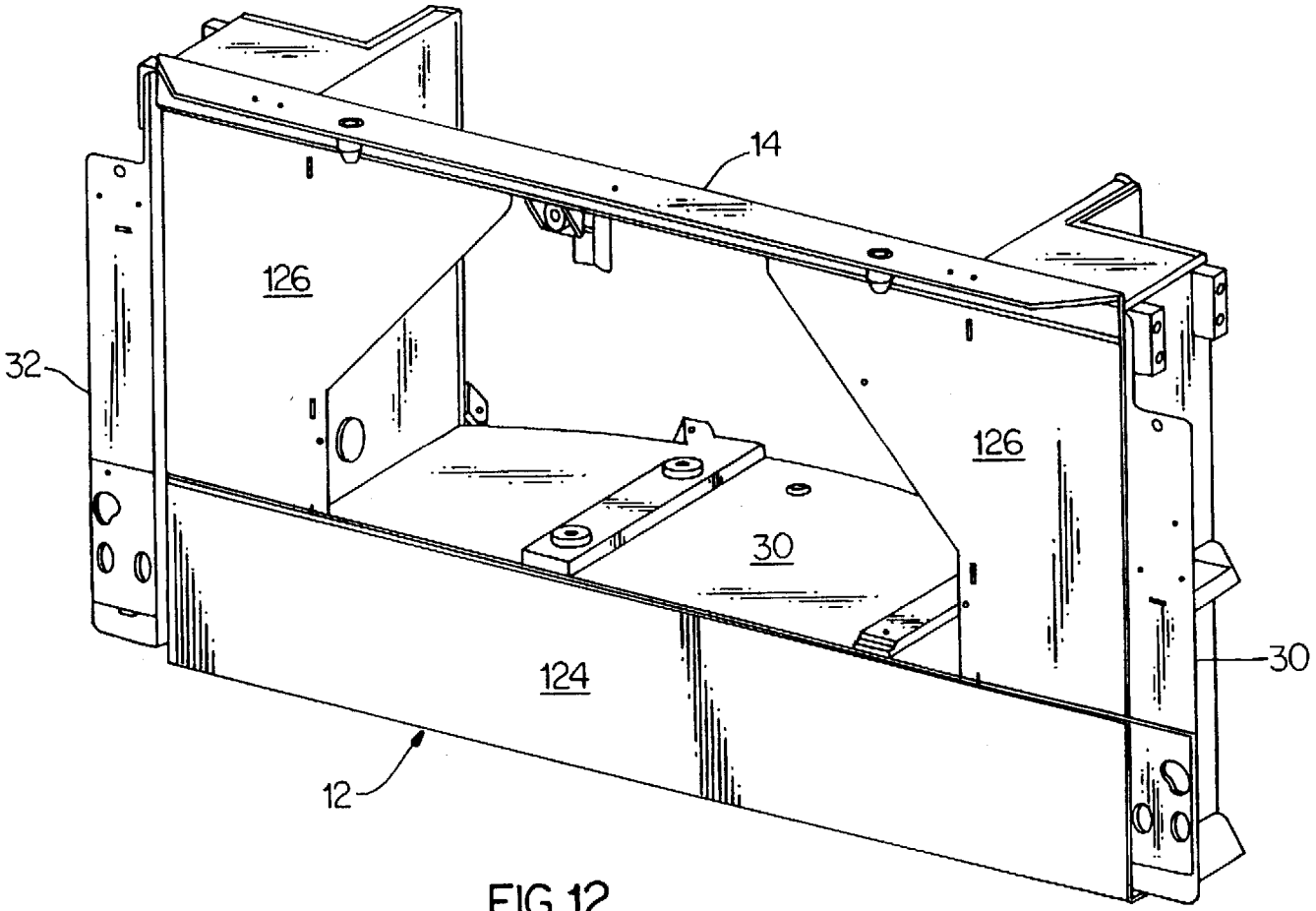
FIG. 12 is a view of the back side of the fuel tank of FIG. 3.

Looking back now at the overall fuel tank structure, following assembly of the basic H-shaped structural framework 68, appropriate internal reinforcing channels 114 as illustrated in FIGS. 4 and 5, are welded to the interior surfaces of the horizontally extending plate 35 and the left and right hand vertical sections 70 and 72. Following this, assembly of the fuel tank is completed by welding the angle iron 14 in place and attaching the other outside panels to complete the fuel tank structure as illustrated. Specifically, this includes welded attachment of the front plate 116, the bottom plate 88, front walls 118 of both the left and right hand tank towers 18 and 20, the outside walls 48 and 58 of both tank towers 18 and 20, the tops 122 of the tank towers 18 and 20 as well as the back walls of the towers 18 and 20, and the lower section 16. As shown in FIG. 12, the back wall of the lower tank comprises a single elongated plate 124. The back walls 126 of the towers 18 and 20 each include a triangular extension which is welded to the angle iron 14 at the upper edge thereof. Finally, the previously described right and left side vertical main structural elements 30 and 32 and the mounting clamps 34 carried thereby are attached.

It should thus be appreciated that a fuel tank for a self contained motor generator set has been described wherein the structural framework of the unit and the integral fuel tank of the unit are formed together to avoid the need for a separate fuel tank and structural framework for the unit. Such an arrangement eliminates the need for multiple welds on top of welds during tank and frame assembly and integration of the separate tank and frame. Such a structure results in reduced weight of the overall structural, increased fuel capacity, reduced cost, and ease of manufacturibility of the entire unit.

What is claimed is:

1. A fuel tank for use with a self contained generator set of the type adapted to be mounted on a transport container, said fuel tank comprising:

a first substantially horizontal structural plate having first and second ends;

a first substantially vertical, elongated structural plate structurally joined at a location on one side thereof, intermediate the length thereof, to said first end of said horizontal plate;

a second substantially vertical, elongated structural plate structurally joined at a location on one side thereof, intermediate the length thereof, to said second end of said horizontal plate;

said first horizontal plate and said first and second substantially vertical, elongated structural plates cooperating to define a substantially H-shaped structural framework for said fuel tank;

said fuel tank further including:

a lower tank section underlying said horizontal plate, said horizontal plate defining an upper surface of said lower tank section;

a first vertically extending tank section adjacent the other side of said first vertical plate, a portion of said first vertical plate forming one side of said first vertical tank section; and a second vertically extending tank section adjacent the other side of said second vertical plate, a portion of said first vertical plate forming one side of said second vertical tank section;

wherein said portions of said first and second vertical plates forming said one sides of said first and second vertical tank sections each extend above said joint with said horizontal plate; and wherein the portion of said first and second vertical plates extending below said joint with said horizontal plate extend into the interior of said fuel tank, and further;

wherein said lower tank section and said first and second vertically extending tank sections are all fluidly interconnected with one another to define the interior of said fuel tank.

2. The apparatus of claim 1 wherein each of said portions of said first and second vertical plates extending into the interior of the said fuel tank have a fluid passage formed therein.

3. The apparatus of claim 2 wherein each of said first and second vertical plates has a re-enforcing device attached to said other side thereof.

4. The apparatus of claim 2 wherein each of said first and second vertically extending tank sections comprises:

an outer side thereof horizontally spaced from said one side thereof, and a front side, a back side, a top, and a bottom, all structurally joined to an interconnecting their respective said one sides and said outer sides of said first and second tank sections.

5. The apparatus of claim 4 further including a structural element extending between and structurally joined to the upper ends of said back sides of each of first and second tank sections.

6. The apparatus of claim 5 wherein all of said structural joints are welds.

* * * * *